United States Patent [19]

Clifford

[11] Patent Number: 4,977,669

[45] Date of Patent: Dec. 18, 1990

[54] POCKET SHAVER

[75] Inventor: Ronald E. Clifford, Encinitas, Calif.

[73] Assignee: Fountain Fresh, Inc., Del Mar, Calif.

[21] Appl. No.: 469,310

[22] Filed: Jan. 24, 1990

[51] Int. Cl.[5] ..... B26B 19/44

[52] U.S. Cl. ..... 30/41; 30/96

[58] Field of Search ..... 30/41, 41.5, 86, 87, 30/88, 125

[56] References Cited

U.S. PATENT DOCUMENTS

| | | | |
|---|---|---|---|
| 1,898,803 | 2/1933 | Young | 30/41 X |
| 2,300,512 | 11/1942 | Landu | 30/41 |
| 4,841,635 | 6/1989 | Maurizi et al. | 30/41 |

FOREIGN PATENT DOCUMENTS

| | | | |
|---|---|---|---|
| 718879 | 2/1942 | Fed. Rep. of Germany | 30/41 |

*Primary Examiner*—Douglas D. Watts

*Attorney, Agent, or Firm*—Frank D. Gilliam

[57] ABSTRACT

A pocketable manual shaver when encased for storage generally shaped like a fountain pen comprising a pliable handle portion containing a shaving substance that interconnects to a shaving head through a combination pivot and valve member. The shaving head includes a shaving blade whereby the shaving substance can be dispensed from the handle through the valve member to an area opposite the shaving blade when the head is rotated relative to the handle to a use position. The combination pivot and valve attachment between the head and handle allows the head to rotate relative to the handle between a stowed position which is inline with the longitudinal centerline of the handle and a use position which is perpendicular to the longitudinal center line of the handle. When the head is rotated to the stowed position, an opening in the head of the pivot and a handle opening extending to the substance are misaligned (valve closed positioned) preventing the substance from leaving the handle and when the head is rotated to the use position the opening in the head of the pivot and the opening to the substance are aligned (valve open position) allowing substance from the handle to be forced through the openings to the area of the pivot opposite the blade by squeezing the handle.

10 Claims, 1 Drawing Sheet

POCKET SHAVER

Several attempts have been made to accomplish a suitable transportable shaving apparatus. Most of these attempts have found limited success for various reasons. Some of these prior art shavers can be found in the following U.S. Pat. Nos. 3,394,715; 3,703,765; 3,985,146; 4,377,034; 4,433,483; 4,696,106; and 4,753,006.

Generally stated these prior art shavers have a one piece or fixedly positioned handle and a perpendicular shaving head including a blade, a container of a shaving substance in the handle or near adjacent thereto and means for dispensing the shaving substance from the handle for manual application to the areas to be shaved. These teaching include a shaver that is of one piece construction which contain no shaving substance but is foldable into a small neat package for carrying. There are no teaching in the prior art examined that contain a shaving substance, fold into a compact size handy for transporting on the person of the user or have a combination valve and pivot between the handle and head for pivoting the head relative to the handle between storage and use positions and simultaneously opening and closing a valve that allows shaving substance to be manually forced into the area opposite the shaving edge of the blade for manual application when the head is rotated for use and prevents substance from being inadvertently forced in the area of the blade when the head is rotated to its stored position.

The shaving device as herein after explained in detail is an advancement in the personal shaver art and should find wide acceptance in the art.

SUMMARY OF THE INVENTION

This invention is directed to a personal shaver for shaving hairs from selected areas of the person of the user, and more particulary to a fold up shaver which can be carried on the person of the user when traveling, etc. that contains a conventional blade, a hollow handle portion with a substantially rigid but somewhat resilient stem and a substance contained within the handle for applying to the body of the user for lubricating the areas to be shaved to enhance the shaving action of the blade.

The shaver of this invention includes a head with a shaving blade carried thereby, a handle stem pivotly attached to the head for relative rotation therebetween, a pliable container attached to the stem of the handle which is filed with a shaving substance such as, for example and not by way of limitation, latherless shaving cream, a shaving gel, shaving foam etc. and passageways through the pivotal connection opposite to the blade edge and between the hollow pliable portion of the handle and the handle stem connection to the head pivot.

For use the head is rotated from a stowed position which is in line with the longitudinal center line of the handle to a use position which is perpendicular to the center line of the handle. In the use position the passageways of the pivotal connection and the handle are aligned forming a direct passageway between the shaving substance and the opening through the pivotal connection to an area on the head opposite to the blade edge. The pliable portion of the handle is then squeezed until a sufficient quantity of shaving substance from the hollow portion of the handle is available at the surface of the head adjacent to the pivotal connection for manual application to the selected areas for shaving those areas. The head is rotated to its handle inline position for storage when the shaving is completed. A pliable tubular cover similar to the pliable portion of the handle encloses the blade area to allow convenient sanitary storage.

A object of this invention is to provide a mechanical safety razor shaving device with a shaving lubricant in the handle thereof that can be dispensed to the shaver head at a location opposite to the blade for manual application to areas of the body to be shaved.

Another object of this invention is to provide a portable shaver which when in a stowed configuration can be safely carried on the person of the user.

Another object of this invention is to provide a portable personal shaving device which contains a shaving lubricant that can not be dispensed when the shaving device is in a stowed configuration.

Still another object of this invention is to provide a portable personal shaving device with a head and a handle interconnected by a pivot from which shaving lubricant can be dispensed only when the shaving device is in a use configuration.

Yet another object of this invention is to provide a personal shaving device having a head and a handle whereby the head and the handle can be aligned longitudinal for storage and the head and handle can be aligned perpendicular for use.

These and other objects and advantages of the present invention will become apparent to those skilled in the art after considering the following detailed specification in which the preferred embodiment are described in conjunction with the accompanying drawing Figures.

BRIEF DESCRIPTION OF THE DRAWING FIGURES

DETAILED DESCRIPTION OF THE PREFERRED EMBODIMENT

Figure 1:
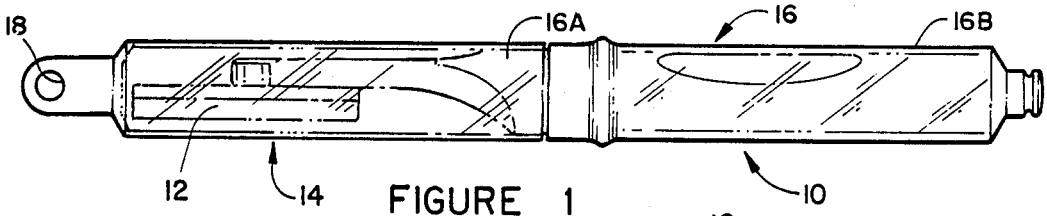
FIG. 1 is a side cutaway view showing of the shaver of the invention in the head stowed position and with the head covered for transport.

Referring now to the various drawing Figures, FIG. 1 is a showing of the personal shaver 10 of the invention encased in a stowed configuration with the head portion 12 enclosed in a removable pliable cover 14 which forms a continuation of the handle portion 16. The handle portion 16 includes a hollow portion 16A and a resilient rigid portion 16B which contains a quantity of shaving lubricant such as, latherless shaving cream, a shaving gel, shaving foam or other suitable shaving lubricant well known in this art. A aperture 18 at the distal end 20 of the removable cover 14 is used to hang the device 10 generally for sales display.

Figure 2:
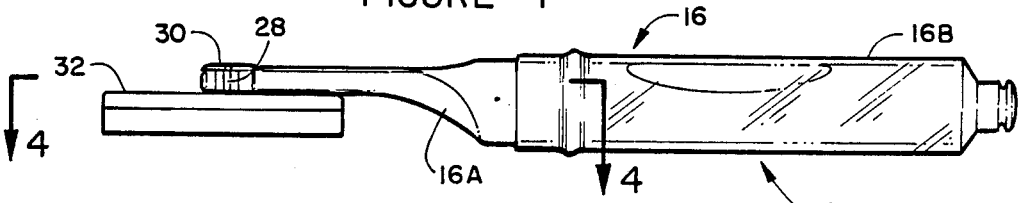
FIG. 2 is an enlarged showing of the shaving head in the FIG. 1 position and a portion of the handle showing the passageway leading from the container in the handle to the head with the cover depicted in FIG. 1 removed.
Figure 3:
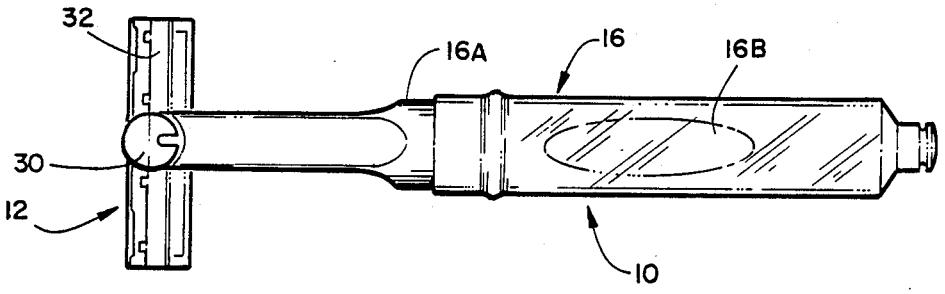
FIG. 3 is the side view showing similar to the FIG. 2 showing with the shaver head rotated to the use position.
Figure 4:
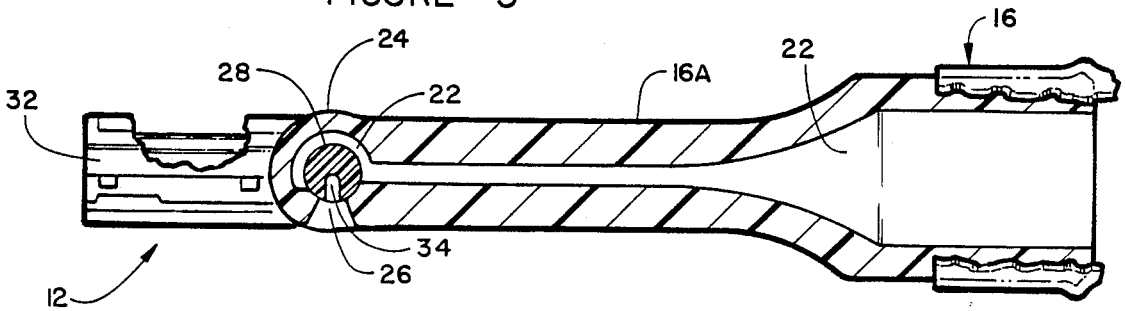
FIG. 4 is a top plan viewing showing the lubricant exit from the head.

Referring now specifically to drawing FIGS. 2–4, FIG. 2 shows the passageway 22 leading from the hollow portion 16B of the handle 16 to the distal end 24 of handle portion 16A on which the head is attached. A slot 26 in the distal end 24 receives the pivot 28 on the end of the head and captures the pivot between the top cap 30 and the upper head surface 32. The material of construction of both the handle portion 16A and the head are rigid but somewhat resilient so that the pivot 28 can be forced through the slot 26 and will be captured therein and yet allow relative rotation between the handle and the head. Plastic has been found to be suitable for this purpose. However, the invention is not so limited as other natural and synthetic materials will work equally as well for this purpose. The wall of the pivot in the FIG. 2 head rotational position prevents any lubricant from the hollow handle from exiting the hollow portion 16B of the handle. As can be clearly seen in the FIGS. 3 and 4 the pivot 28 has a vertical cutaway portion 34 perpendicular to the longest dimension of the head. When the head is rotated from the FIG. 2 position to the FIG. 3 position the cutaway portion is directly in front of the passageway 22 of the handle. Positioned in this manner allows the handle which is constructed from a very thin and pliable material, such as plastic or the like or any other material suitable for the purpose intended, to be squeezed forcing lubricant from the hollow portion of the handle, through the passageway 22, up the cutaway portion 34 and out the opening 36 in the top cap 30 to the top surface of the head for manual application to areas to be shaved. When the shaving operation is completed the head is rotated to the FIG. 1 and 2 position which closes the communication between the hollow portion of the handle and the cutaway portion of the pivot terminating any external flow of lubricant from the hollow portion of the handle.

Figure 5:
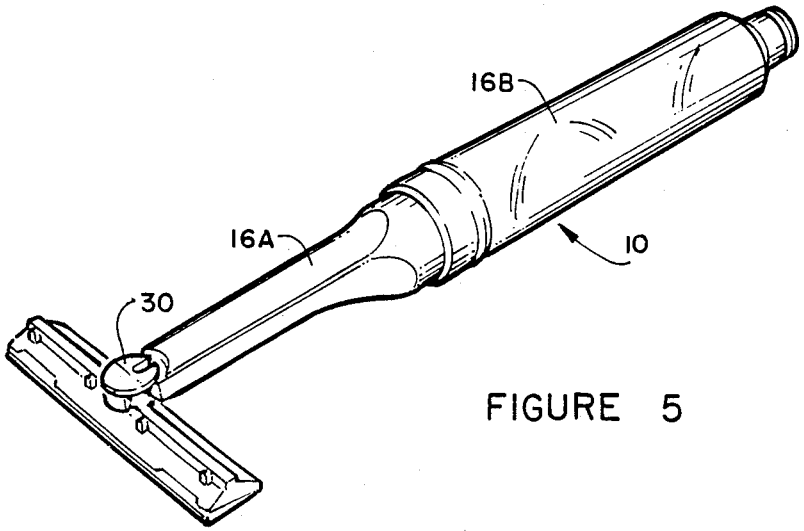
FIG. 5 is a section taken along line 5—5 of FIG. 3.

Referring specifically to drawing FIG. 5, this figure is a cutaway showing of the head depicting the location of the blade.

The pliable portion 16B may be joined to the rigid portion 16A by adhesive means or the like or by thermal fusing together of the two materials.

While there have been shown and described preferred embodiment of the personal shaving device in accordance with the invention, it will be appreciated that many changes and modifications may be made therein without, however, departing from the essential spirit thereof.

What is claimed is:

1. An improved storable personal shaver comprising:

a handle with a hollow portion and a passageway extending from said hollow portion to one end of said handle;

a shaving head pivotally attached to said one end of said handle;

a pivotal means for connecting said handle to said shaving head, said pivotal means including a vertical slot through a portion thereof which aligns with said passageway when said shaving head is rotated to a use position relative to said handle and allows communication between the outer surface of the top of said shaving head and said hollow portion and when said shaving head is rotated to a storage position communication between the hollow portion of said handle and said outer surface of the top of said shaving head is terminated.

2. The invention as defined in claim 1 wherein said hollow portion of said handle contains a shaving lubricant and when said shaving head is rotated to a use position and said handle is squeezed lubricant from said handle exits to the top surface of said shaving head for manual application to the areas to be shaved.

3. The invention as defined in claim 1 further comprises a cover which encloses said shaving head for storage.

4. The invention as defined in claim 1 wherein said handle includes a substantially rigid portion and a pliable squeezable hollow portion for containing a shaving lubricant.

5. The invention as defined in claim 4 wherein said rigid portion and said pliable portion are joined by adhesive means.

6. The invention as defined in claim 1 further comprise a pliable cover member which encloses said head when said head is in a storage position.

7. The invention as defined in claim 4 further comprises a pliable cover member which encloses said head when said head is in a storage position, said cover is constructed from the same pliable material as said hollow portion and forms a continuation of said pliable portion.

8. The invention as defined in claim 1 wherein said head is constructed from a resilient rigid material.

9. The invention as defined in claim 4 wherein said head is constructed from the same material as the rigid portion of the handle.

10. The invention as defined in claim 4 wherein said rigid portion and said pliable portion are joined by a press fit of said rigid portion into said pliable portion.

* * * * *